US006041940A

United States Patent [19]

Owings

[11] Patent Number: 6,041,940

[45] Date of Patent: Mar. 28, 2000

[54] METAL DETECTION APPARATUS

[76] Inventor: Michael J. Owings, 1935 Desert Flower, Cottonwood, Ariz. 86326

[21] Appl. No.: 08/986,266

[22] Filed: Dec. 5, 1997

[51] Int. Cl.[7] ..... B03B 7/00

[52] U.S. Cl. ..... 209/44; 209/447; 209/490; 209/506

[58] Field of Search ..... 209/44, 425, 435, 209/437, 440, 446, 447, 448, 449, 450, 485, 486, 506, 490, 491

[56] References Cited

U.S. PATENT DOCUMENTS

| | | | |
|---|---|---|---|
| 388,575 | 8/1888 | Nixdorff | 209/414 |
| 570,132 | 10/1896 | Krasel . | |
| 865,178 | 9/1907 | Hardwick | 209/447 |
| 1,948,797 | 2/1934 | Nicolai | 209/447 |
| 3,316,545 | 4/1967 | Reed | 340/236 |
| 3,941,690 | 3/1976 | Poawers et al. | 209/443 |
| 4,359,686 | 11/1982 | Wherry | 324/326 |
| 4,472,269 | 9/1984 | Swick | 209/44 |
| 4,641,091 | 2/1987 | Cone | 324/202 |
| 4,642,180 | 2/1987 | Kaufman | 209/506 X |
| 4,983,281 | 1/1991 | Montelione | 209/418 |
| 5,421,461 | 6/1995 | Ruzic | 209/44 |

FOREIGN PATENT DOCUMENTS

| | | | |
|---|---|---|---|
| WO 89/10195 | 11/1989 | WIPO | 209/44 |

OTHER PUBLICATIONS

Gold and Treasure Hunter magazine, Jan. 1996, various Advertisements.

White's catalog of metal detectors, 1994, various metal detectors.

Keene Engineering catalog, 1994, various sluices.

*Primary Examiner*—Tuan N. Nguyen

*Attorney, Agent, or Firm*—Frank J. McGue

[57] ABSTRACT

An apparatus for detecting metal in materials is disclosed. The apparatus has, in combination, a sifter for sifting materials onto a metal detector plate assembly, the metal detector plate assembly having a metal detector plate in electrical communication with a metal detector alarm.

16 Claims, 2 Drawing Sheets

METAL DETECTION APPARATUS

TECHNICAL FIELD

This invention relates to the field of metal detection apparatuses, and, more particularly, to metal detection apparatuses for use in connection with precious metal prospecting.

BACKGROUND OF THE INVENTION

Various types of metal detection apparatuses, and particularly, precious metal detection apparatuses are known in the art. These devices include beachcomber-type metal detectors which generally comprise an elongated shaft with a handle at one end, a circular magnetic detector plate at the other end, and an electronic alarm which indicates the presence of metal objects proximate to the detector plate. However, once the presence of metal is detected, the user must use a shovel or the like to dig out whatever triggered the detector alarm and visually inspect to determine if the metal is valuable.

Another common method is panning for gold. This method involves the use of a pan in which suspected gold bearing dirt or gravel is swished about with water. The lighter gravel and dirt tailings are expelled from the pan while the heavier gold or metal particles are retained within the bottom of the pan. One disadvantage is that the user does not have any idea whether gold or precious metal is within the pan until after the panning is complete. In addition, learning the skill of proper panning does take some distinct effort.

Still another common method which takes advantage of the heavy density of gold and other metals is the use of a sluice box. The sluice box is generally an elongated box having a rectangular cross section with one short side open. The box is tilted whereby water runs from the closed short side to the open short shirt. A series of baffles extend laterally across the direction of flow of the water. The baffles trap the heavier metal particles while the gravel and dirt tailings are expelled with the water. Often, these sluice boxes are combined with pumps and/or dredges to continuously search for gold or other metals in streams and the like. Sluice box devices do require substantial amounts of water to operate efficiently. In addition, the user does not know if any gold or other metal is present until a visual inspection of the materials trapped within behind the baffles.

There have been a number of attempts to address the shortcomings of the known prior art. Both U.S. Pat. No. 4,359,686 entitled "Metal Detection Apparatus with Basket" which issued on Nov. 16, 1982 to Wherry and U.S. Pat. No. 4,983,281 entitled "Metal Detector Scoop Sifter" which issued on Jan. 8, 1991 to Montelione disclose a beachcomber style metal detector employing sifting basket or scoop in combination with a metal detector to retrieve metal.

U.S. Pat. No. 5,421,461 entitled "Panning Apparatus" which issued on Jun. 6, 1995 to Ruzic discloses a panning apparatus having upper tray and lower tray receiving stations all supported on a stand.

U.S. Pat. No. 3,941,690 entitled "Portable Sluice Pan" which issued on Mar. 2, 1976 to Powers et al. provides a portable sluice pan which may be hand held.

U.S. Pat. No. 388,575 entitled "Sifter" which issued on Aug. 28, 1888 to Nixdorff provides a sifter which may be shaken by hand.

None of the known prior art disclose the combination set forth herein.

SUMMARY OF THE INVENTION

It is an object of this invention to provide a precious metal detection apparatus which quickly notifies the user whether or not such material is present within the processed material.

It is a further object of this invention to provide a metal detection apparatus which is suitable for use with wet or dry materials.

It is still another object of this invention to provide a portable, lightweight metal detection apparatus which quickly and easily processes suspected precious metal bearing material.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
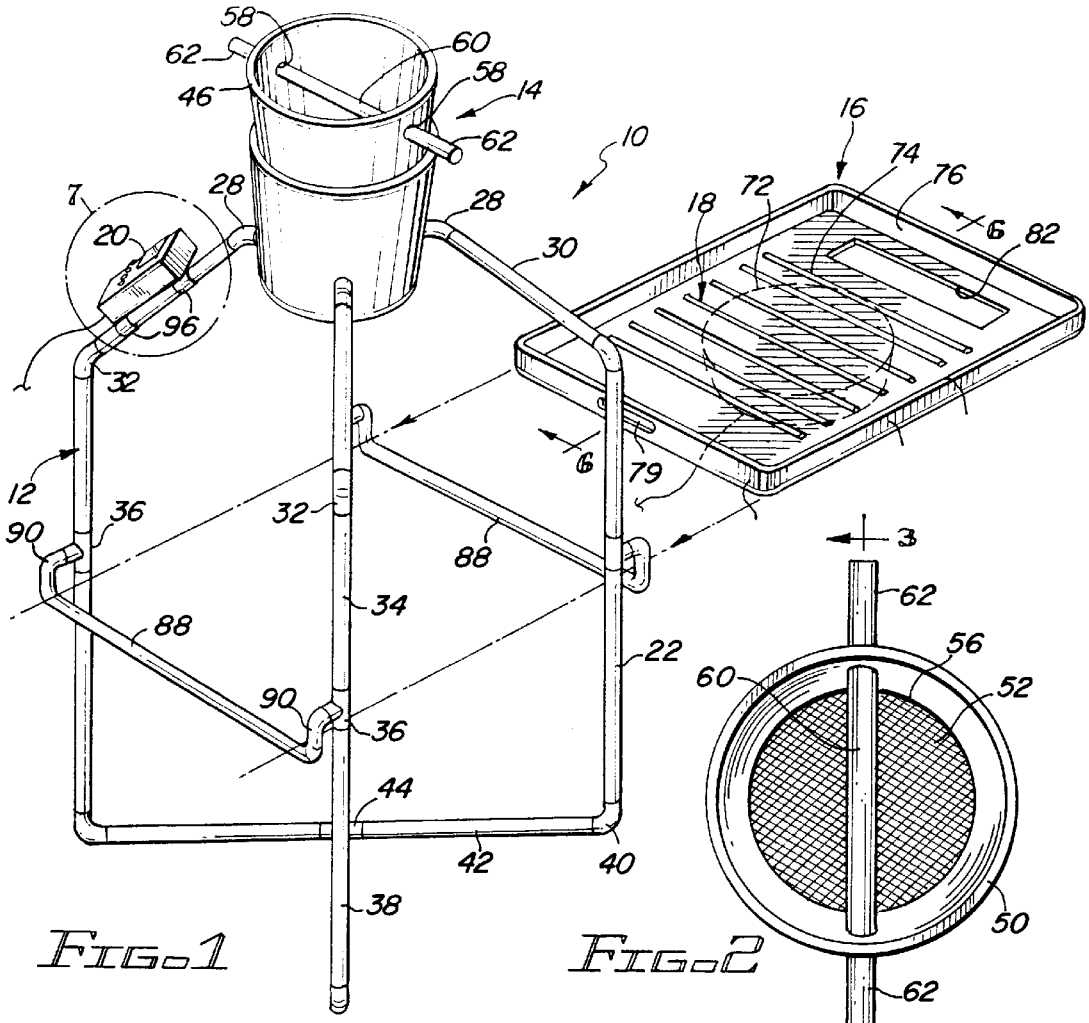
FIG. 1 is a perspective view of one embodiment of the present invention.

Referring more particularly to the drawings by characters of reference, FIGS. 1–12 disclose combinations of features of the present invention which constitute various embodiments of a metal detection apparatus 10. Metal detection apparatus 10 comprises a stand 12, means for sifting 14, and a metal detector plate assembly 16. Metal detector plate assembly 16 preferably includes means for separating gravel from metal 18 and a metal detector plate 18 in electrical communication with a metal detector alarm 20.

As best seen in FIG. 1, in one embodiment, stand 12 comprises four legs 22 oriented at ninety degrees from one another. In this embodiment, legs 22 are sections of polyvinyl piping which are removably joined by an upper cross coupler 24 best seen in FIG. 5. It will be understood by those skilled int the present invention can be made from many other non-magnetic materials such as other plastics or wood.

In the present preferred embodiment, each leg 22 comprises a horizontal section 26 extending laterally from upper cross coupler 24 to one end of an upper forty five degree coupler 28. Another end of upper forty five degree coupler 28 extends downwardly to join horizontal section 26 to angled section 30. Angled section 30 extends to one end of a lower forty five degree angle coupler 32. Another end of lower forty five degree angle coupler 32 extends downwardly to join to upper vertical section 34. Upper vertical section 34 extends to one arm of a T-coupler 36 which is further described below.

The other arm of T-coupler 36 joins to lower vertical section 38. Lower vertical section 38 extends to one end of a ninety degree coupler 40. The other end of ninety degree coupler 40 extends inwardly and horizontally from lower section 38 to join to a base horizontal section 42 which, in turn, joins a base cross coupler 44 to which the other three legs 22 join.

In the preferred embodiment described herein, metal detection apparatus 10 is easily broken down into component elements at each coupler to provide portability. Those skilled in the art will recognize other means for providing portability such as folding/locking legs and the like. Further, the presently described embodiment has four legs though the invention can be easily adapted to, for example, a tripod configuration.

Figure 2:
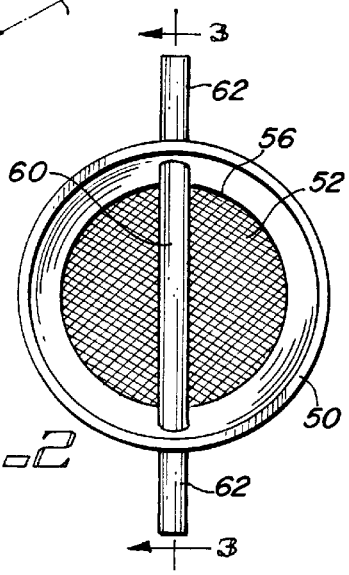
FIG. 2 is a top view of a sifting basket employed in the present invention.
Figure 3:
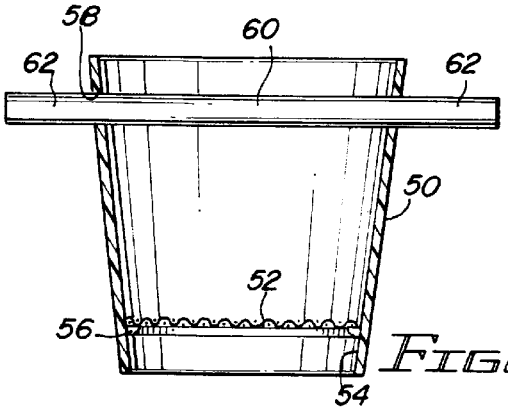
FIG. 3 is a cross sectional view of FIG. 2 taken along line 3—3.

In the preferred embodiment, means for sifting 14 comprises a sifting basket 46 and an ore bin 48. As best seen in FIGS. 2 and 3, sifting basket 46 is preferably bucket-shaped having a sloping side 50 and an open bottom 54. A sifting mesh 52 is mounted on a shoulder 56 extending inwardly from sloping sides 50 and covers open bottom 54. Preferably, sifting mesh 52 is a very coarse screen, generally allowing any material less than ½ inch wide to pass therethrough. However, sifting mesh 52 preferably simply lays atop shoulder 56 and is easily changeable to a different screen size as desired.

Two opposing holes 58 extend through the upper area of sloping side 50 which slidably receive a handle 60. Handle 60 extends completely through sifting basket 46 and provides grips 62 on opposing sides thereof. A user grasps grips 62 and can rotate sifting basket 46 to sift material therethrough and also to provide means for lifting sifting basket 46 accommodate the dumping of tailings therefrom.

Figure 4:
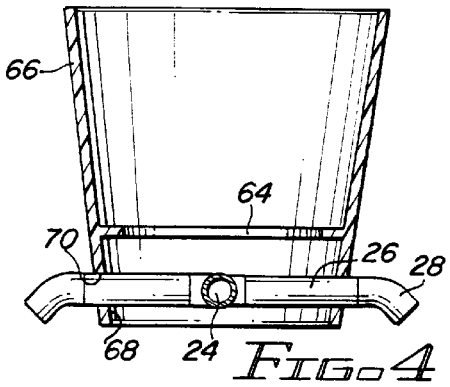
FIG. 4 is a cross sectional side view of an ore bin used in the present invention.
Figure 5:
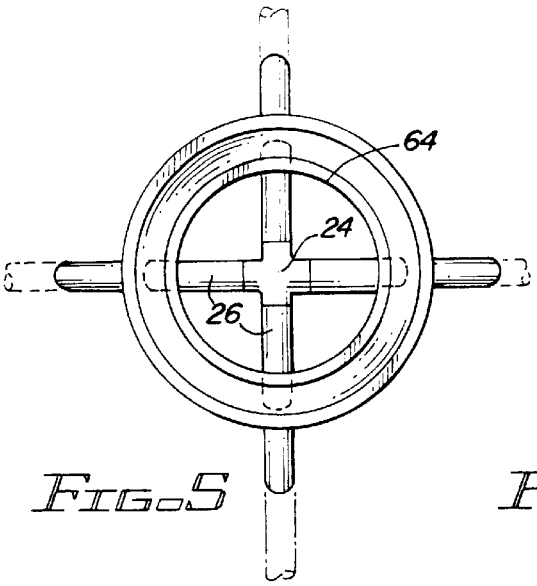
FIG. 5 is a top view of the ore bin used in the present invention.

Sifting basket 46 rests inside ore bin 48. As best seen in FIGS. 4 and 5, ore bin 48 includes an ore bin shoulder 64 upon which sifting basket 46 rests. Ore bin 48 is also bucket-shaped and includes an ore bin sloping side 66 and an ore bin open bottom 68 which allows sifted material from sifting mesh 52 to drop therethrough.

At ninety degree intervals proximate to open bottom 68 below shoulder 64, four section holes 70 are provided through sloping side 66. Horizontal sections 26 extend therethrough and connect with upper cross coupler 24 as best seen in FIG. 5. Horizontal sections 26 thereby provide means for centrally mounting ore bin 48 and sifting basket 46 between legs 22.

Metal detector plate assembly 16 is mounted directly below means for sifting 14. As best seen in FIGS. 1, 6, 10 and 12, metal plate assembly 16 includes means for separating gravel from metal 18 and a metal detector plate 19. In the preferred embodiment, means for separating gravel (tailings) from metal is a rectangular sluice 72 having a plurality of baffles 74 extending horizontally across. Vertical sides 76 surround sluice 72. Sluice 72 preferably slopes downwardly from each short sides 78 to a low point in the middle 80. Preferably, one short side 78 includes an elongated slot 79 which is suitable for a hand to grasp. Also, a tailings dump hole 82 is provided at one end of sluice 72.

Figure 6:
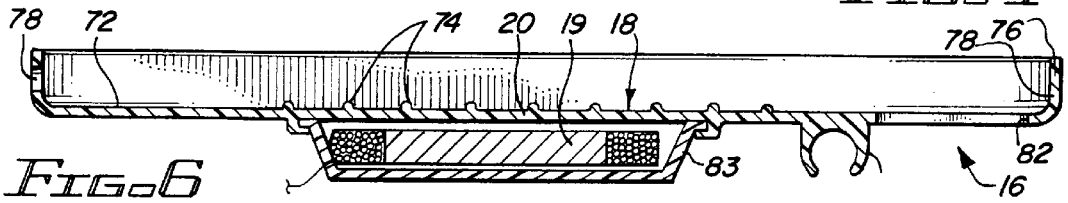
FIG. 6 is a cross sectional side view of a metal detector plate assembly of FIG. 1 taken along line 6—6.
Figure 12:
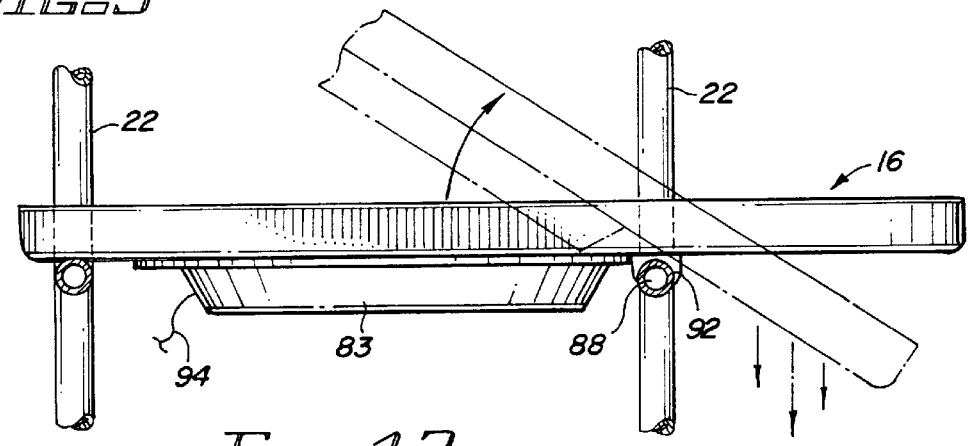
FIG. 12 is a side view of the metal detector plate assembly showing the movement thereof to dump tailings therefrom.

Mounted beneath sluice 72 is metal detector plate 19 which is enclosed within a housing 83. In the embodiments of FIGS. 6 and 12, metal detector plate 19 is fixed in one location, namely, middle 80 of sluice 72. In an alternate embodiment seen in FIG. 10, metal detector plate 19 includes a metal detector handle 84 extending laterally therefrom. In this embodiment, metal detector plate 19 is manually slidable within housing 83 via the use of handle 84.

Figure 11:
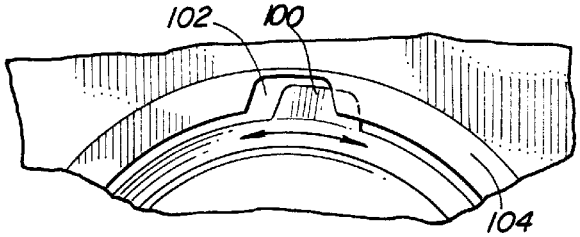
FIG. 11 is a top view of an alternate embodiment of the present invention showing a metal detector plate engagement device.

As best seen in FIG. 11, housing 83 is secured to the bottom of sluice 72 by an ear 100 which engages a corresponding gap 102 in a mounting sleeve 104. When housing 83 is rotated, ear 100 releasably engages a lip 106 of sleeve 104.

Metal plate assembly 16 is mounted between legs 22 by two opposed U-shaped mounting bars 88 which extend between adjoining legs 22. Mounting bars 88 are removably attached to respective legs 22 via L-shaped connectors 90 which are connected to the legs of T-couplers 36 previously described.

A snap-on fitting 92 best seen in FIGS. 6 and 12 is mounted to the bottom of sluice 72 between middle 80 and tailings dump hole 82. Fitting 92 releasably engages one of the mounting bars 88 thereby holding metal detector plate 19 directly beneath means for sifting 14. In addition, fitting 92 allows metal plate assembly 16 to rotate about mounting bar 88 as shown in FIG. 12 to dump tailing via dump hole 82.

Figure 7:
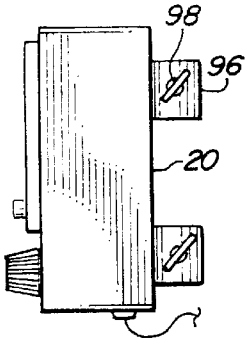
FIG. 7 is a side view of a metal detector alarm of FIG. 1 shown in circle 7.
Figure 8:
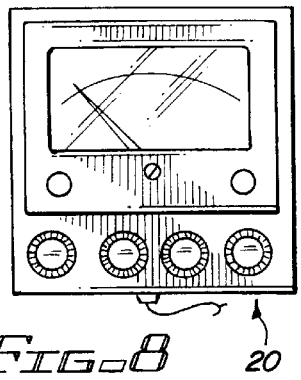
FIG. 8 is a front view of the metal detector alarm of FIG. 7.
Figure 10:
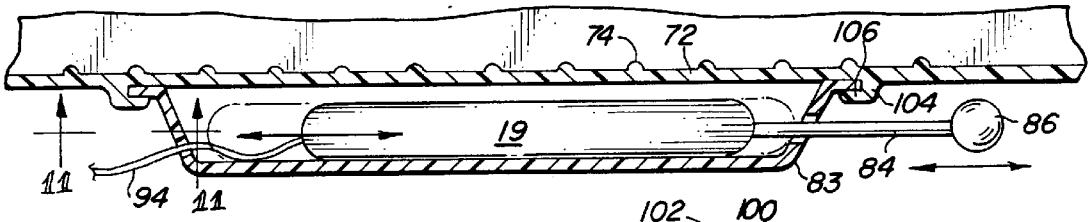
FIG. 10 is an alternate embodiment of the metal detector plate assembly having a movable metal detector plate.
Figure 9:
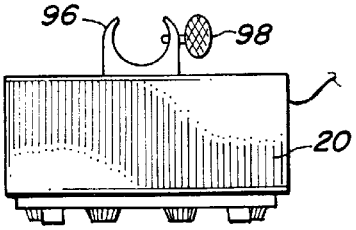
FIG. 9 is a top view of the metal detector alarm of FIG. 7.

Metal detector plate 19 is electrically connected to metal detector alarm 20 via electrical cord 94. As best seen in FIGS. 7 and 9, metal detector alarm 20 is mounted on any one of angled sections 30 of legs 22 via two clamps 96 and secured thereto by butterfly screws 98.

Metal detector plate 19 and metal detector alarm 20 are commercially available from many suppliers, including, but not limited to, White's Electronics, Inc. of Sweet Home, Oregon; Garrett Electronics, Inc. of Garland, Tex.; Bounty Hunter Corporation of El Paso, Tex. as well as many others. Simply, metal detector plate 19 and metal detector alarms 20 are elements of the beachcomber type metal detection devices described in the background of the invention.

Those skilled in the art will recognize that many variations of this invention are possible. For example, a very large, approximately 60 inch diameter metal detector plate can be used in place of metal detector plate assembly 16 in its entirety. Thus, material from the ore bin 48 falls directly on the detector plate 19.

In use, material is generally shoveled into sifting basket 46. The user grasps grips 62 and rotates sifting basket 46 to sift the material through sifting mesh 52, ore bin 48 and onto sluice 72. The user would inspect the larger pieces remaining within sifting basket 46 for any visible metal and then dump the remaining material.

The material which passes through sifting basket 46 to sluice 72 will activate the metal detector alarm 20 if the metal detector plate 19 encounters any metal therein. If no metal is detected, the user can use elongated slot 79 to rotate metal detector plate assembly 16 about snap fitting 92 and dump the tailing from tailing dump hole 82.

If metal is detected, the user can use elongated slot 79 to move plate assembly back and forth (after disengaging snap fitting 92) to manually separate the metal from the tailings using baffles 74 on sluice 72. The user will know when all metal has been located and removed when metal detector alarm 20 no longer indicates the presence of metal on sluice 72. The remaining tailings are dumped as previously described through tailings dump hole 82.

Although only certain embodiments have been illustrated and described, it will be apparent to those skilled in the art that various changes and modifications may be made therein without departing from the spirit of the invention or from the scope of the appended claims. For example, the present preferred embodiment emphasizes portability and thus uses manual sifting and sluicing to separate metals. Those functions can easily be motorized via vibrators and the like. However, such equipment adds considerably weight including a power source. If such weight concerns are not an issue, mechanical devices are certainly within the framework of the present invention.

What is claimed is:

1. An apparatus for detecting metal in materials, the apparatus comprising, in combination:

means for sifting materials onto a metal detector plate assembly, the metal detector plate assembly having a metal detector plate in electrical communication with a metal detector alarm, said means for sifting includes a sifting basket, said sifting basket being bucket-shaped and having a sloping side and an open bottom, said sifting basket having a sifting mesh removably mounted on a shoulder extending inwardly from the sloping side, said sifting mesh covering said open bottom, and said means for sifting further including an ore bin, said ore bin being bucket-shaped and having a sloping side and an open bottom, the ore bin including a shoulder upon which the sifting basket rests.

2. The apparatus of claim 1 wherein said metal detector plate assembly further comprises means for separating metal from materials.

3. The apparatus of claim 1 being made of non-magnetic substances.

4. The apparatus of claim 1 further comprising a stand, said means for sifting metals and said metal detector plate assembly being mounted on said stand, said metal detector plate assembly being mounted beneath said means for sifting materials.

5. The apparatus of claim 4 wherein said stand includes four legs oriented at ninety degrees from one another.

6. The apparatus of claim 1 wherein said sifting mesh is a very coarse screen.

7. The apparatus of claim 1 wherein said sifting basket further comprises a grips on opposing sides thereof.

8. The apparatus of claim 7 wherein said sifting basket includes two opposing holes extending through the sloping side, the two opposing holes slidably receiving a handle, the handle extending completely through sifting basket thereby forming said grips.

9. The apparatus of claim 1 wherein said ore bin is mounted on a stand, said metal detector plate assembly being mounted on said stand, said metal detector plate assembly being mounted beneath said ore bin.

10. The apparatus of claim 4 wherein said metal plate assembly is mounted between the legs by two opposed U-shaped mounting bars which extend between adjoining legs, said mounting bars being rotatably and removably attached to one of said mounting bars.

11. An apparatus for detecting metal in materials, the apparatus comprising, in combination:

means for sifting materials onto a metal detector plate assembly, the metal detector plate assembly having a metal detector plate in electrical communication with a metal detector alarm, said metal detector plate being enclosed within a housing, means for separating gravel from metal comprising a rectangular sluice having a plurality of baffles extending horizontally across, said sluice further having vertical sides, the sluice sloping downwardly from the vertical sides to a low point in the middle thereof wherein said metal detector plate is mounted beneath the sluice.

12. The apparatus of claim 11 wherein one of said vertical sides includes an elongated slot which is suitable for a hand to grasp.

13. The apparatus of claim 11 further comprising a tailings dump hole at one end of the sluice.

14. The apparatus of claim 11 wherein the metal detector plate is movable within the housing.

15. An apparatus for detecting metal in materials, the apparatus comprising, in combination:

a sifting basket, said sifting basket being bucket-shaped and having a sloping side and an open bottom, said sifting basket having grips on opposing sides thereof, said sifting basket having a coarse sifting mesh removably mounted on a shoulder extending inwardly from the sloping side, said sifting mesh covering said open bottom, an ore bin, said ore bin being bucket-shaped and having a sloping side and an open bottom, the ore bin including a shoulder upon which the sifting basket rests, means for sifting materials onto a metal detector plate assembly, the metal detector plate assembly having a metal detector plate in electrical communication with a metal detector alarm, the metal detector plate assembly further comprising a rectangular sluice having a plurality of baffles extending horizontally across, said sluice further having vertical sides, one of said vertical sides including an elongated slot which is suitable for a hand to grasp, the sluice sloping downwardly from the vertical sides to a low point in the middle thereof, the sluice having a tailings dump hole at one end thereof, the metal detector plate being mounted beneath the sluice in a housing, a stand including four legs oriented at ninety degrees from one another, said ore bin and said metal detector plate assembly being mounted on said stand, said metal detector plate assembly being mounted beneath said ore bin.

16. The apparatus of claim 15 wherein the metal detector plate is movable within the housing.

* * * * *